US006450157B1

(12) United States Patent
Kesler et al.

(10) Patent No.: US 6,450,157 B1
(45) Date of Patent: Sep. 17, 2002

(54) AUTOMOTIVE IGNITION SYSTEM WITH ADAPTABLE START-OF-DWELL RING DAMPING

(75) Inventors: Scott B. Kesler, Kokomo, IN (US); John W. Boyer, Westfield, IN (US)

(73) Assignee: Delphi Technologies, Inc., Troy, MI (US)

( * ) Notice: Subject to any disclaimer, the term of this patent is extended or adjusted under 35 U.S.C. 154(b) by 119 days.

(21) Appl. No.: 09/609,797

(22) Filed: Jul. 3, 2000

(51) Int. Cl.[7] ..... F02P 11/00; F02P 3/055

(52) U.S. Cl. ..... 123/630; 123/632; 315/209 M

(58) Field of Search ..... 315/209 T, 209 M, 315/209 CD, 119, 210, 211, 209 R; 123/630, 632; 307/10.3

(56) References Cited

U.S. PATENT DOCUMENTS 4,356,809 A * 11/1982 Lo Cascio ..... 123/146.5 D
4,402,299 A * 9/1983 Nakao et al. ..... 123/632
5,611,318 A * 3/1997 Kesler ..... 123/630
5,819,713 A * 10/1998 Kesler ..... 123/630

* cited by examiner

*Primary Examiner*—Don Wong
*Assistant Examiner*—Chuc Tran
(74) *Attorney, Agent, or Firm*—Jimmy L. Funke

(57) ABSTRACT

An automotive ignition system includes a control circuit (52) operable to drive a coil current switching device (24) connected to an ignition coil (30) referenced at battery voltage. The control circuit (52) includes a drive circuit (20) and ring damping circuit (58) producing an inhibit signal (INH) to which the drive circuit (20) is responsive to control the state of the coil drive signal (GD). In a single pulse ignition system; i.e., an ignition system employing a single coil charging event per combustion cycle, the ring damping circuit (58) is responsive to a spark control signal (ESTBF) to control charging and discharging of a single capacitor (C1) to define the inhibit signal (INH). In a multiple pulse ignition system; i.e., an ignition system employing multiple coil recharging cycles following a standard initial charging dwell cycle, the ring damping circuit (58) is responsive to the spark control signal (ESTBF) and at least two mode signals (M1, M2) to control charging and discharging of the single capacitor (C1) throughout the initial and subsequent coil charging cycles to define the inhibit signal (INH). In either case, the drive circuit (20) is responsive to the inhibit signal (INH) to disable current flow through the primary ignition coil (30) when the inhibit signal (INH) is enabled, and to enable current flow through the primary ignition coil (30) when the inhibit signal (INH) is disabled.

18 Claims, 6 Drawing Sheets

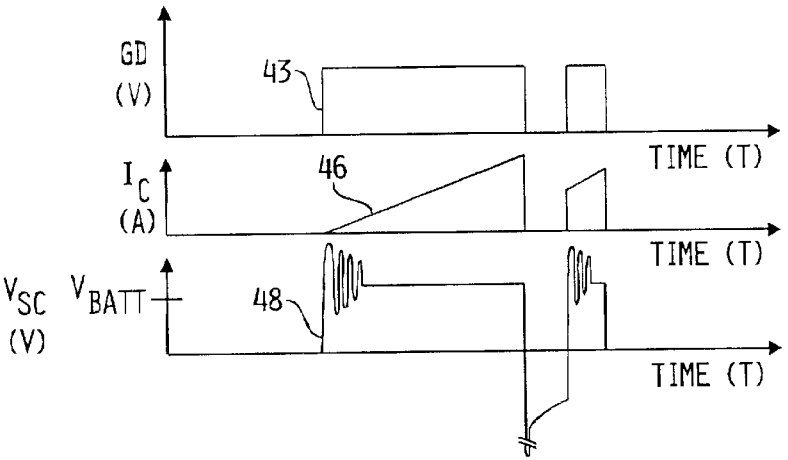
FIG. 3A (PRIOR ART)
FIG. 3B (PRIOR ART)
FIG. 3C (PRIOR ART)
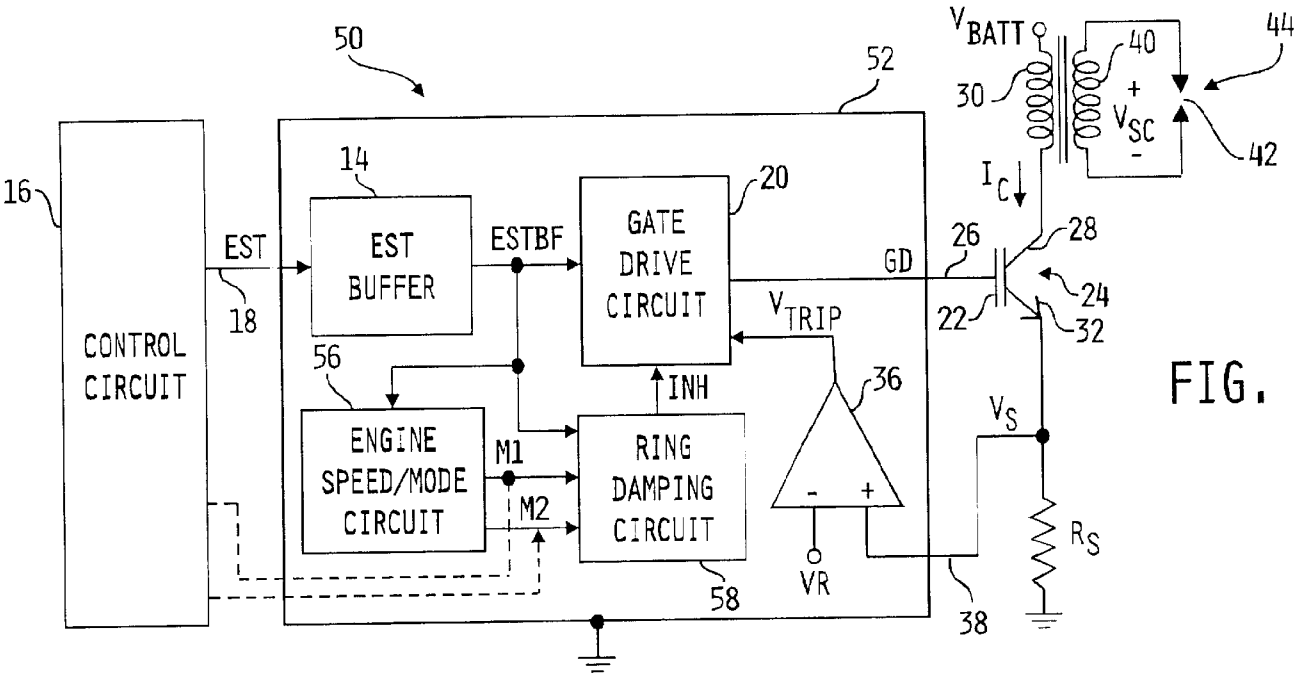
FIG. 4

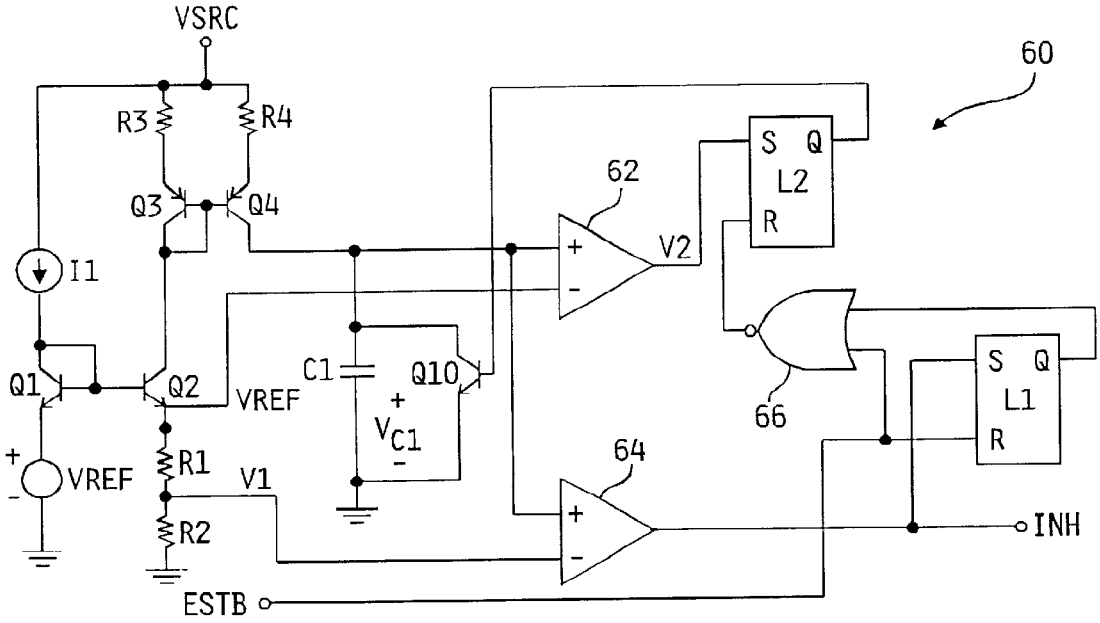
FIG. 5
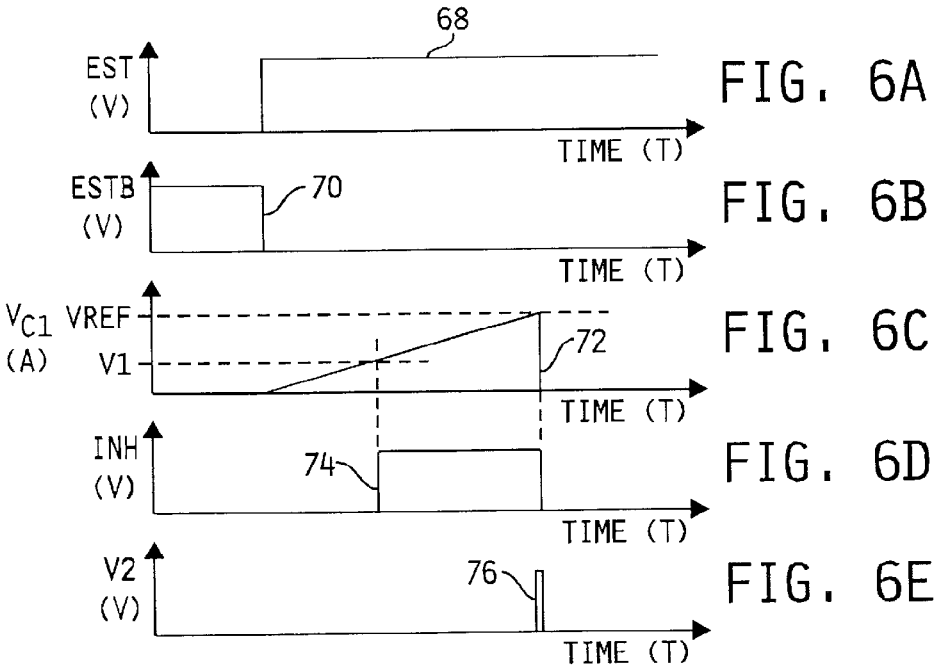

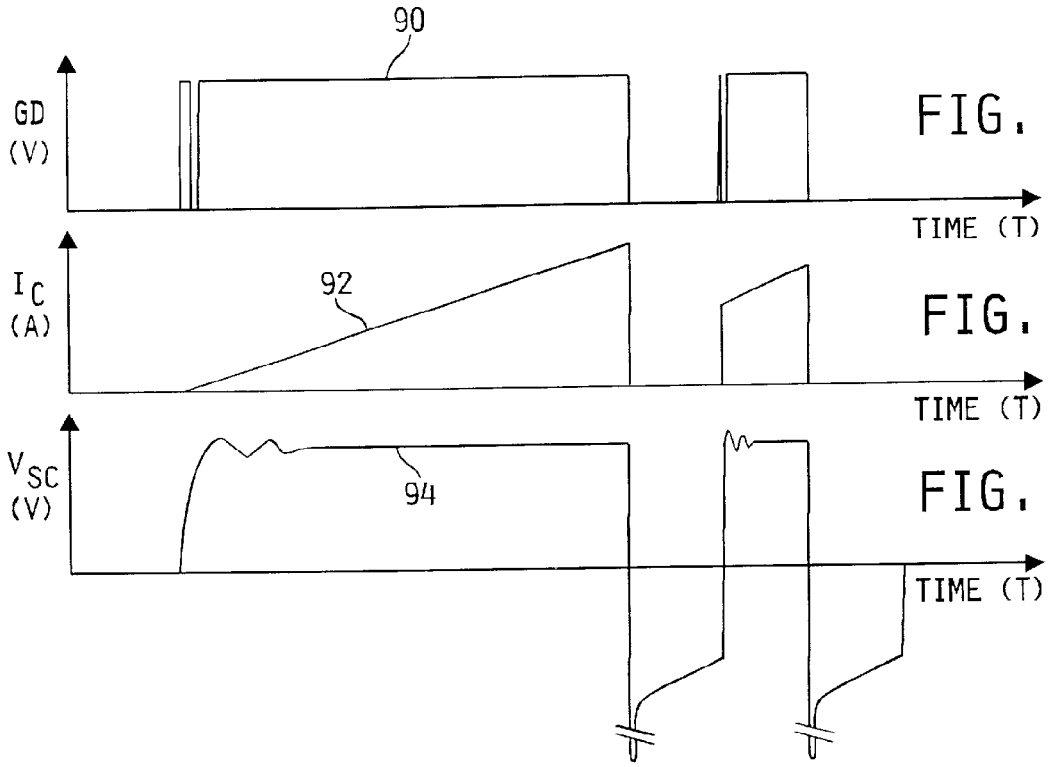
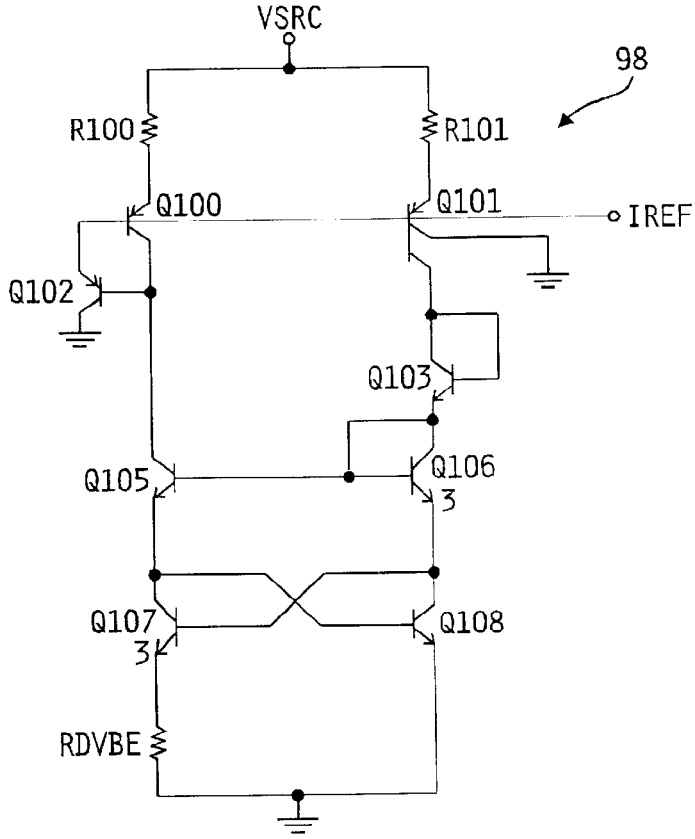
FIG. 10

AUTOMOTIVE IGNITION SYSTEM WITH ADAPTABLE START-OF-DWELL RING DAMPING

TECHNICAL FIELD

The present invention relates generally to automotive ignition systems, and more specifically to systems for minimizing ignition coil ringing effects resulting from coil activation.

BACKGROUND OF THE INVENTION

Modern inductive-type automotive ignition systems commonly utilize power switching devices to control the flow of current through an ignition coil. Such devices are typically controlled so as to switch from an "off" state to a fully saturated "on" state within a short time period, wherein such switching results in the voltage across the ignition coil changing rapidly from substantially zero volts to near battery voltage. The inductive nature of the ignition coil reflects and steps up this voltage across the primary coil to the secondary coil connected to an ignition plug, wherein the initial response of the secondary coil to this process may result in ringing. This ringing may, in some cases, create sufficient voltage across the spark gap of the ignition plug to cause a spark event. Such a mistimed spark event is undesirable and potentially damaging to the engine.

Referring to FIG. 1, one known example of an ignition system 10 of the type just described is illustrated in FIG. 1, wherein system 10 includes an ignition control circuit 12 having an electronic spark timing (EST) buffer circuit 14 receiving an EST control signal from a control circuit 16 via signal path 18. The EST buffer circuit 14 buffers the EST control signal and provides a buffered EST control signal ESTBF to a gate drive circuit 20. The gate drive circuit 20 is responsive to the ES TBF signal to supply a gate drive signal GD to a gate 22 of an insulated gate bipolar (IGBT) transistor 24 or other coil switching device via signal path 26. A collector 28 of IGBT 24 is connected to one end of a primary coil 30 forming part of an automotive ignition coil having an opposite end connected to battery voltage $V_{BATT}$. An emitter 32 of IGBT 24 is connected to one end of a sense resistor $R_S$ having an opposite end connected to ground potential, and to a noninverting input of a comparator 36 via signal path 38. An inverting input of comparator 36 is connected to a reference voltage VR, and an output of comparator 36 supplies a trip voltage $V_{TRIP}$ to gate drive circuit 20. A secondary coil 40 is coupled to the primary coil 30 and is connected to an ignition plug 44 defining a spark gap 42 as is known in the art.

In the operation of system 10, gate drive circuit 20 is responsive to a rising edge of an ESTBF signal to supply a gate drive signal GD to the gate 26 of IGBT 24 as shown by the GD waveform 45 in FIG. 2A. As IGBT 24 rapidly begins to conduct in response to the gate drive signal GD, a coil current $I_C$ begins to flow through primary coil 30, as shown by the coil current ($I_C$) waveform 47 in FIG. 2B, thereby establishing a "sense voltage" $V_S$ across resistor $R_S$. Due to the rapid turn on of IGBT 24 and subsequent rapid increase in voltage across the primary coil 30 to near battery voltage $V_{BATT}$, ringing effects may result in the initial portion of the $V_{SC}$ waveform 49 as shown in FIG. 2C due to known LRC effects of the ignition coil. This ringing, as described hereinabove, may be sufficient to undesirably create a spark event across the gap 44 of ignition plug 42.

As the coil current $I_C$ increases due to the inductive nature of the ignition coil, the sense voltage $V_S$ across $R_S$ likewise increases until it reaches the comparator reference voltage VR. At this point, the comparator 36 switches state and the corresponding change in state of the trip voltage $V_{TRIP}$ causes the gate drive circuit 20 to turn off or deactivate the gate drive voltage GD so as to inhibit the flow of coil current $I_C$ through the primary coil 30 and coil current switching device 24. This interruption in the flow of coil current $I_C$ through primary coil 30 causes primary coil 30 to induce a current in the secondary coil 40, wherein the secondary coil 40 is responsive to this induced current to generate desired arc across the spark gap 42 of ignition plug 44.

To minimize, or at least reduce, ringing effects associated with the activation of coil current switching devices, a technique commonly referred to as "phased turn-on", or PTO, has been developed. PTO reduces the ringing voltage illustrated in FIG. 2C by initiating the coil charging period with a carefully timed initial drive pulse to the coil current switching device (e.g., IGBT 24 of FIG. 1). Details relating to the foregoing PTO technique are described in U.S. Pat. No. 5,392,754 which is assigned to the assignee of the present invention, and the disclosure of which is incorporated herein by reference. In accordance with the concepts described in the '754 patent, the coil current switching device is initially turned on for a short time period (e.g., 2–7 microseconds), turned off for a similar time period, and then turned on again for the duration of the coil charging dwell period. The durations of the initial "on" and "off" periods are dependent upon the characteristics of the ignition coil being driven and are chosen such that the ringing created by the second turn-on is 180 degrees out of phase with the ringing produced by the initial turn-on. If the pulse timing is selected properly, this "phasing" of the coil response effectively damps the overall voltage response at the terminals of the secondary coil 40 and reduces the peak ringing voltage by as much as 50%. The use of this ring suppression technique can eliminate the need for an additional blocking diode in the coil assembly.

Another advancement in modern ignition systems is the use of multiple coil charging and spark events for a single combustion cycle. By generating multiple sparks in a rapid sequence, more spark energy can be delivered to the combustion cylinder than with a single spark event, thereby enhancing ignition of the air/fuel mixture. In accordance with this known technique, the coil current switching device (e.g., IGBT 24) is switched back on before all of the coil energy has been depleted, thereby recharging the primary coil 30 to its peak value from some intermediate coil current level as shown by the GD waveform 43 and $I_C$ waveform 46 in FIGS. 3A and 3B respectively. While only one recharging cycle is illustrated in FIGS. 3A–3C, it is known to use any desired number of recharge cycles, wherein systems of this type will be referred to hereinafter as multiple pulse ignition systems. One drawback to such a system, however, is that the unused energy within the ignition coil when the switching device is turned back on changes the coil's response to the voltage transitions resulting from the switching of the coil current switching device. Referring to FIGS. 3A and 3C, for example, not only does the abrupt rising edge of the initial GD signal 43 result in a corresponding ringing of the secondary voltage $V_{SC}$, as shown by waveform 48, but every rising edge thereafter of the GD signal 43 results in similar $V_{SC}$ ringing which may result in an unwanted spark event. The peak level of this ringing can be 50% higher than the baseline "make" voltage (e.g., $V_{BATT}$*coil turns ratio "N"), and may therefore cause mistimed spark events. Addition of a diode in series with the secondary coil 40 can also prevent a "spark-on-make" for a negative voltage system, although such a diode would interfere with potential ion current detection in an "ion sense" ignition system, and a PTO technique is therefore critical for such applications.

What is therefore needed is an improved phased turn-on strategy. Such a modified PTO strategy should ideally be readily adaptable to any number of coil charging events to thereby minimize or at least reduce the resulting ringing events associated with the secondary coil voltage $V_{SC}$ in a multiple pulse ignition system. The strategy should further include provisions for adjusting the pulse widths of the PTO pulses to compensate for the known energy remaining in the coil as well as to account for variations in ignition system operating parameters such as engine speed, battery voltage and/or other engine operating parameters.

SUMMARY OF THE INVENTION

The foregoing shortcomings of the prior art are addressed by the present invention. In accordance with one aspect of the present invention, an ignition control circuit comprises a first circuit producing first, second and third reference voltages, a capacitor, a second circuit responsive to a spark control signal to begin charging the capacitor, a third circuit responsive to a first mode control signal to enable an inhibit signal when a charge on the capacitor reaches the first reference voltage and to disable the inhibit signal when the charge on the capacitor reaches the second reference voltage, a fourth circuit responsive to a second mode control signal to enable the inhibit signal when the charge on the capacitor reaches the third reference voltage and to disable the inhibit signal when the charge on the capacitor reaches the second reference voltage, and a fifth circuit responsive to the inhibit signal to disable current flow through an ignition coil when the inhibit signal is enabled and to enable current flow through the ignition coil when the inhibit signal is disabled.

In accordance with another aspect of the present invention, a method of controlling an ignition system comprises the steps of charging a capacitor in response to a spark control signal, comparing a charge on the capacitor with a first reference voltage in response to a first mode signal, comparing the charge on the capacitor with a second reference voltage in response to a second mode signal, comparing a charge on the capacitor with a third reference voltage, the third reference voltage greater than the first and second reference voltages, disabling current flow through an ignition coil when the charge on the capacitor reaches either of the first and second reference voltages, and enabling current flow through the ignition coil when the charge on the capacitor reaches the third reference voltage.

One object of the present invention is to provide an ignition control circuit for implementing an improved phased turn-on ring damping strategy.

Another object of the present invention is to provide such a circuit hat is readily adaptable to a multiple pulse ignition system.

These and other objects of the present invention will become more apparent from the following description of the preferred embodiments.

BRIEF DESCRIPTION OF THE DRAWINGS

The present invention will now be described, by way of example, with reference to the accompanying drawings, in which:

FIG. 3A is a plot of gate drive voltage vs. time illustrating operation of the ignition control system of FIG. 1 employing multiple coil recharging cycles following an initial charging dwell cycle;

FIG. 3B is a plot of coil current vs. time illustrating operation of the ignition control system of FIG. 1 employing multiple coil recharging cycles following an initial charging dwell cycle;

FIG. 3C is a plot of secondary coil voltage vs. time illustrating operation of the ignition control system of FIG. 1 employing multiple coil recharging cycles following an initial charging dwell cycle;

FIG. 4 is a diagrammatic illustration of one preferred embodiment of an automotive ignition control system, in accordance with the present invention;

FIG. 5 is a combination schematic and block diagram illustration of one preferred embodiment of the ring damping circuit of FIG. 4 configured for a single pulse ignition system in accordance with the present invention;

FIG. 6 is composed of FIGS. 6A–6E illustrating various waveforms associated with the operation of the circuit shown in FIG. 5;

FIG. 8 is composed of FIGS. 8A–8C illustrating various waveforms associated with the operation of the circuit of FIG. 4 configured for a multiple pulse ignition system;

FIG. 10 is a device-level schematic diagram illustrating one preferred embodiment of a current generating circuit for use with the ring damping circuit of FIG. 9.

DESCRIPTION OF THE PREFERRED EMBODIMENTS

Figure 1:
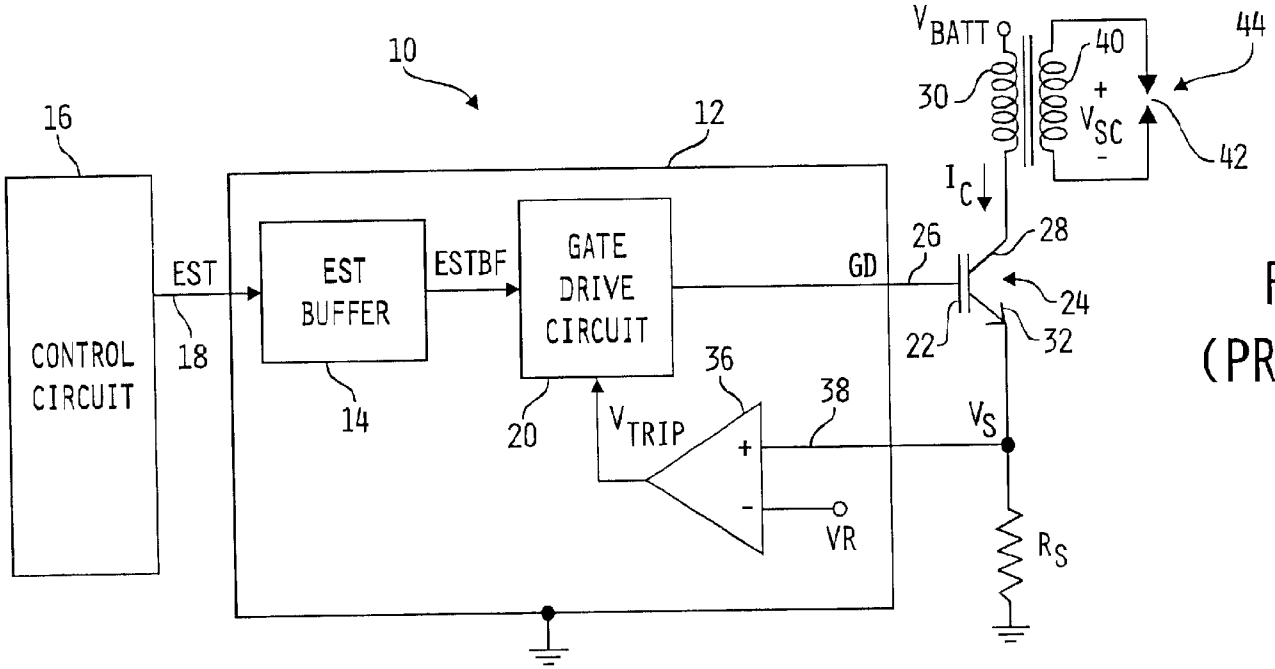
FIG. 1 (PRIOR ART)
FIG. 1 is a diagrammatic illustration of a prior art automotive ignition control system.

Referring now to FIG. 4, one preferred embodiment of an automotive ignition control system 50, in accordance with the present invention, is shown. System 50 is similar in many respects to system 10 illustrated in FIG. 1, and like structure is therefore identified with like reference numbers. For example, system 50 includes a control circuit 16 producing an electronic spark timing signal (EST) for controlling spark events. Control circuit 16 is preferably a microprocessor-based control circuit including at least a memory and a number of input/output ports, and in one embodiment is a so-called engine (or electronic) control module (ECM) as this term is known in the art. Alternatively, control circuit 16 may be any known circuit operable to provide an EST control signal according a desired ignition control strategy. Like system 10, system 50 also includes a coil current switching device 24 which is, in one embodiment, an insulated gate bipolar transistor (IGBT) as shown in FIG. 2, but may alternatively be another power switching device of known construction including, but not limited to, a power metal-oxide-semiconductor field effect transistor (MOSFET), one or more bipolar transistors (e.g., single transistor or darlington configuration), one or more relays, or the like. In any case, system 50 will be described hereinafter as having an IGBT 24 with a gate 22, collector 28 and emitter 32, it being understood that device 24 may alternatively take the form of other known power switching devices such as any of those provided by example hereinabove. System 50, like system 10, further includes a primary coil 30 of an automotive ignition coil having one end connected to a source of battery voltage $V_{BATT}$ and an opposite end connected to the collector 28 of IGBT 24. The primary coil 30 is coupled to a secondary coil 40 having opposite terminals connected to opposing electrodes of an ignition plug 44 defining a spark gap 42 therebetween. The emitter 32 of IGBT 24 is connected to one end of a sensor resistor $R_S$ having an opposite end connected to ground potential, wherein the common connection of the emitter 32 and sense resistor $R_S$ defines a sense voltage $V_S$.

System 50 also includes an ignition control circuit 52 similar in many respects to ignition control circuit 12 of FIG. 11, and like numbers are therefore used to identify like blocks of circuitry. For example, like circuit 12, circuit 52 includes an EST buffer circuit 14 of known construction receiving the EST signal from control circuit 16 and producing a buffered EST signal ESTBF corresponding thereto. Also, like circuit 12, circuit 52 includes a gate drive circuit 20 of known construction receiving the ESTBF signal from circuit 14 and producing a gate drive signal GD corresponding thereto, wherein the gate drive signal GD is supplied to the gate 22 of IGBT 24 via signal path 26. The emitter 32 of IGBT 24 is connected to a non-inverting input of a comparator 36 via signal path 38 carrying the sense voltage $V_S$. The inverting input of comparator 36 is connected to a reference voltage VR, and the output of the comparator 36 supplies a trip voltage $V_{TRIP}$ to the gate drive circuit 20.

Figure 2A:
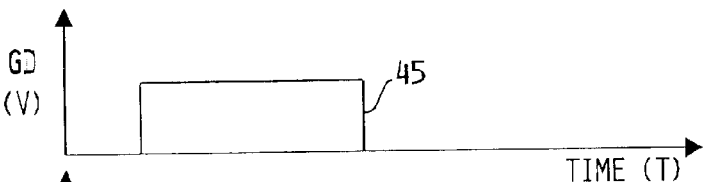
FIG. 2A (PRIOR ART)
FIG. 2A is a plot of gate drive voltage vs. time illustrating operation of the ignition control system of FIG. 1.
Figure 2B:
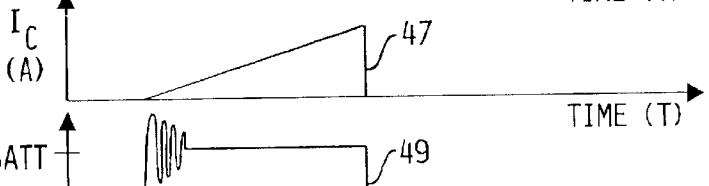
FIG. 2B (PRIOR ART)
FIG. 2B is a plot of coil current vs. time illustrating operation of the ignition control system of FIG. 1.
Figure 2C:
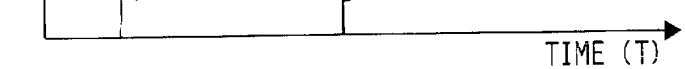
FIG. 2C (PRIOR ART)
FIG. 2C is a plot of secondary coil voltage vs. time illustrating operation of the ignition control system of FIG. 1.

Unlike circuit 12 of FIG. 1, circuit 52 includes a ring damping circuit 58 receiving at least the buffered EST signal from EST buffer circuit 24 and providing an inhibit signal to the gate drive circuit 20. In a single pulse system, the ring damping circuit 58 includes only a single input receiving the buffered EST signal ESTBF, and the engine speed/mode logic circuit 56 illustrated in FIG. 4 may be omitted. In this case, the ring damping circuit 58 is responsive only to the buffered EST signal ESTBF to define the inhibit signal INH, wherein the gate drive circuit 20 is responsive to an enabled state of the inhibit signal INH to turn off IGBT 24 and thereby disable current flow through the primary coil 30, and to a disabled state of the inhibit signal INH to turn IGBT 24 back on and thereby enable current flow through the primary coil 30. In a multiple pulse system, circuit 52 includes an engine speed/mode circuit 56 receiving the ESTBF signal from EST buffer circuit 14 and producing a number of mode signals with at least one of the mode signals corresponding to an indicator of whether the engine is operating at high or low engine speed, and at least another of the mode signals corresponding to whether the present gate drive signal GD is a standard initial dwell pulse or a recharge pulse. Although the circuitry of the present invention is adaptable to any number of coil charging events, the detailed description of the circuitry will be limited for brevity's sake to one embodiment illustrating a single pulse strategy and another embodiment illustrating a two-pulse strategy; i.e., a standard initial coil charging event followed by a second coil recharging event. As will be described in greater detail hereinafter, however, the circuitry of the present invention is adaptable to any number of multiple pulses (coil recharging events).

In a two-pulse system, engine speed/mode circuit 56 is operable to provide two mode signals, M1 and M2 to ring damping circuit 58, wherein the state of M1 is dependent upon engine speed as indicated by the EST signal. In one embodiment, for example, M1 is a logic low level if engine speed is below a predefined engine speed threshold, and is a logic high level if engine speed is at or above the predefined engine speed threshold. These logic levels may, of course, be reversed in an alternate embodiment without detracting from the scope of the present invention. Mode signal M2, on the other hand, is preferably a logic high level if the present gate drive signal GD is a standard dwell pulse and is a logic low level if GD is a recharge pulse. These logic levels may likewise be reversed in an alternate embodiment without detracting from the scope of the present invention. As an alternative to the engine speed/mode circuit 56 shown in FIG. 4, control circuit 16 may be configured to supply any one or more of the mode signals to the ring damping circuit 58 as shown in phantom in FIG. 4. Circuit 56 or similar circuitry within circuit 16 may be of known construction and/or wherein construction of such a logic circuit is well within the knowledge of a skilled artisan.

The operation of system 50 and of ignition control circuit 52 is identical in some respects to the operation of system 10 and of the ignition control circuit 12 of FIG. 2. For example, in a single pulse mode, the EST buffer circuit 14 is responsive to the EST signal to supply a buffered EST signal ESTBF to gate drive circuit 20 which is, in turn, responsive thereto to supply a gate drive signal GD to the gate 22 of IGBT 24 to thereby turn on IGBT 24 and begin conducting coil current $I_C$ therethrough from battery voltage $V_{BATT}$, through primary coil 30 and through sense resistor $R_S$ to ground potential. The sense voltage $V_S$ increases due to the increasing coil current $I_L$ through primary coil 30, and when $V_S$ reaches VR, $V_{TRIP}$ switches state. When $V_{TRIP}$ changes state, this causes the gate drive circuit 20 to turn off or deactivate the gate drive voltage GD so as to inhibit the flow of coil current $I_C$ through the primary coil 30 and coil current switching device 24. This interruption in the flow of coil current $I_C$ through primary coil 30 causes primary coil 30 to induce a current in the secondary coil 40 coupled thereto, wherein the current induced in the secondary coil 40 generates an arc across the spark gap of an ignition plug 42 connected thereto. The operation of system 50 in a multiple pulse mode is similar to that just described with the exception that the gate drive circuit 20 is operable to reactivate IGBT 24, before all of the energy dissipates from the ignition coil, to thereby recharge the primary coil 30 to its coil current trip level. This reactivation cycle may be carried out any desired number of times.

Unlike the ignition control circuit 12 of FIG. 1, ignition control circuit 52 includes a ring damping circuit 58 operable to minimize or at least reduce ringing of the secondary coil voltage $V_{SC}$ in response to a rapid rising edge of the gate drive signal GD by producing an appropriately timed inhibit signal INH. The timing of the inhibit signal INH is typically determined as a function of the characteristics of the ignition coil wherein such determinations are within the knowledge of a skilled artisan. The gate drive circuit is responsive to an active or enabled inhibit signal INH to deactivate, or turn off, IGBT 24, and to an inactive or disabled inhibit signal INH to activate, or turn on, IGBT 24.

In a multiple pulse system, the ring damping circuit 58 provides individual pulse width setups for each desired state of operation (e.g., normal dwell charge, recharge, high speed recharge, etc.) by implementing a plurality of resistor pairs along with a corresponding plurality of associated timing comparator circuits. The circuit 60 of FIG. 5 shows the basic function of any one of these timing circuits, but may also be used by itself in a single pulse ignition system to minimize or at least reduce ringing of the secondary coil voltage $V_{SC}$. In any case, the operation of the basic block shown in FIG. 5 will be described, followed by a description of the invention circuitry that allows multiple occurrences of this block to work together to form a multi-mode phased turn-on ignition system (e.g., for a multiple pulse system).

FIG. 5 illustrates a simplified diagram of one preferred embodiment of a single mode phased turn-on circuit 60 for use as the ring damping circuit 58 of FIG. 4 in a single pulse system, in accordance with the present invention. Circuit 60 includes a current source I1 supplying a current to the collector and base of a transistor Q1 having an emitter connected to a voltage source VREF. The base of Q1 is connected to the base of Q2, wherein Q1 and Q2 accordingly define a known current mirror. The emitter of Q2 is connected to one end of a first resistor R1 having an opposite end connected to one end of a second resistor R2 having its opposite end connected to ground potential. The emitter of Q2 defines the voltage VREF and is connected to an inverting input of a comparator 62. The common connection of R1 and R2 defines the voltage V1 and is connected to an inverting input of another comparator 64. The collector of Q2 is provided as an input to another current mirror comprising Q3 and Q4, wherein an output of this current mirror; i.e., the collector of Q4, is connected to the non-inverting inputs of both comparators 62 and 64 as well as to one end of a capacitor C1 defining a voltage $V_{C1}$ there across.

The output of the first comparator 62 defines a voltage V2 and is connected to a "set" input of a latch circuit L2 having a "Q" output connected to the base of a transistor Q10 having a collector and emitter each connected to opposite terminals of capacitor C1. A "reset" input of L2 is connected to an output of a NOR gate 66 having one input connected to a "Q" output of another latch circuit L1 and a second input connected to a "reset" input of L1 and receiving an inverted EST signal ESTB. The output of comparator 64 defines an output of circuit 60 carrying the inhibit signal INH and is also connected to the "set" input of latch circuit L1.

The operation of circuit 60 will now be described with reference to the waveforms illustrated in FIGS. 6A–6E. When the EST signal (FIG. 6A) produced by control circuit 16 is in a low state such that IGBT is off, latch L1 is reset by the inverted version of the EST signal ESTB (FIG. 6B), thereby forcing its "Q" output to a low state. Once EST transitions to a high state at the beginning of a dwell state, both inputs of the NOR gate 66 become low causing its output to become high. This high level output of NOR gate 66 resets latch L2, thereby causing its "Q" output to go low and turn off transistor Q10. Up to this point, Q10 has been driven into a saturated mode of operation discharging capacitor C1. When Q10 gets turned off, however, capacitor C1 begins charging (FIG. 6C) via current provided by the current mirror composes of Q3 and Q4. When C1 is charged to the level defined by reference voltage V1 (FIG. 6C), comparator 64 outputs a high level signal INH (FIG. 6D). The gate drive circuit 20 is responsive to this high level INH signal to turn off IGBT 24. This high level INH signal also sets latch L1, thereby driving its "Q" output high and preventing any reset of latch L2.

Capacitor C1 continues to charge until the voltage $V_{C1}$ (FIG. 6C) reaches the higher reference voltage VREF. At this point, comparator 62 produces a high level voltage V2 (FIG. 6E) at its output forcing the "Q" output of latch L2 to a high state and turning on transistor Q10, thereby discharging capacitor C1. As C1 is discharged below the level defined by V1, the INH output of comparator 64 goes low (FIG. 6D). The circuit 60 remains in this state until the EST input signal switches low at the end of the dwell period. At this time, the inverted EST signal ESTB resets latch L1 and the output of NOR gate 66 remains low preventing a reset of L2. L2 is finally reset by NOR gate 66 when the EST signal transitions to a high state at the beginning of the next dwell cycle. Once reset, L2 turns off Q10, thereby allowing C1 to begin a new charging cycle.

From the foregoing, it should be apparent that the timing of the initial gate drive (GD) "on" period and the subsequent "off" period are dictated by the charging current impressed upon C1 and the reference voltage levels VREF and V1. Preferably, all of these variables are defined by resistors R1 and R2 in the following manner. As shown in FIG. 5, reference voltage source VREF is imposed on the emitter of Q1 wherein the voltage at the base of Q1 is therefore defined as VREF+Vbe (i.e., base-emitter voltage of Q1). The currents through Q1 and Q2 are preferably similar so that the Vbe of Q2 is substantially the same as the Vbe of Q1, and the voltage at the emitter of Q2 is therefore substantially equal to VREF. Voltage V1 is developed by the resistor divider formed by resistors R1 and R2 which also form the current used to charge capacitor C1 by defining the current through Q2 as VREF/(R1+R2). This current is mirrored by transistors Q3 and Q4 and is forced onto capacitor C1. The rate of charge of C1 is therefore defined by the sum (R1+R2). The reference voltage defining the initial gate drive (GD) turn off point is defined by the ratio of R1 to R2 and is defined by the equation VREF*(R2/(R1+R2)). This configuration allows the initial "on" period (Ton) and the subsequent "off" period (Toff) to be set up by appropriate selection of R1 and R2,wherein Ton=C1*R2 and Toff=C1*R1.

The present invention extends the foregoing strategy to allow for multiple timing configurations to thereby adapt the system to any desired number of timing patterns as may be required by variations in the stored energy in the ignition coil at the time that a recharge cycle is initiated. The present invention allows for such different configurations, each independent of the others, without the need for more than one timing capacitor. In the interest of brevity, only a two-mode (i.e., two pulse) case will be described, although it is to be understood that any number of individual configurations may be combined in a single system application.

In addition to using only a single capacitor, the multiple pulse ring damping circuit of the present invention makes multiple use of the higher reference voltage comparator (e.g., comparator 62 of FIG. 5). The end of the "off" period of the inhibit signal INH is therefore always defined by when the capacitor reaches the primary reference voltage VREF. This leaves the sums and ratios of the configuration resistors (e.g., R1 and R2 of FIG. 5) as the only variables, thereby allowing the multiple modes to be set up in the same fashion as described with respect to circuit 60 of FIG. 5.

Figure 7:
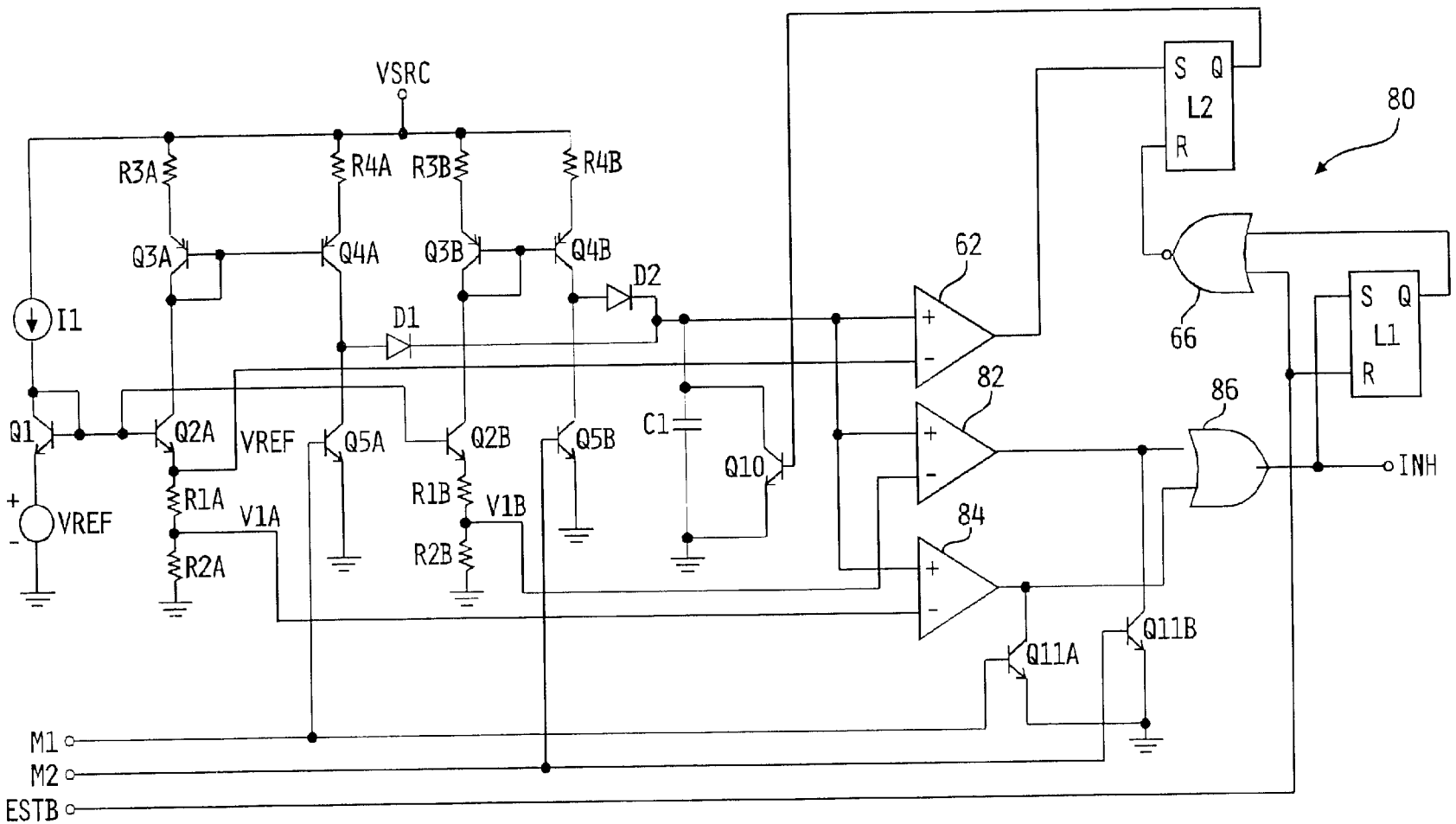
FIG. 7 is a combination schematic and block diagram illustration of one preferred embodiment of the ring damping circuit of FIG. 4 configured for a multiple pulse ignition system in accordance with the present invention.

Referring now to FIG. 7, a simplified diagram of one preferred embodiment of a two mode phased turn-on circuit 80 for use as the ring damping circuit 58 of FIG. 4 in a multiple pulse system, in accordance with the present invention, is shown. Circuit 80 is similar in many respects to circuit 60 of FIG. 5, as just described, and includes a current source I1 supplying a current to the collector and base of a transistor Q1 having an emitter connected to a voltage source VREF. The base of Q1 is connected to the base of Q2A, wherein Q1 and Q2A accordingly define a known current mirror. The emitter of Q2A is connected to one end of a first resistor R1A having an opposite end connected to one end of a second resistor R2A having its opposite end connected to ground potential. The emitter of Q2A defines the voltage VREF and is connected to an inverting input of a comparator 62. The common connection of R1A and R2A defines the voltage V1A and is connected to an inverting input of another comparator 84. The collector of Q2A is provided as an input to another current mirror comprising Q3A and Q4A, wherein an output of this current mirror; i.e., the collector of Q4A, is coupled through a diode D1 to the non-inverting inputs of comparators 62 and 84 and also of a third comparator 82 as well as to one end of a capacitor C1.

The base of Q2A is also connected to the base of transistor Q2B having an emitter connected to one end of a resistor R1B having an opposite end connected to another resistor R2B referenced at ground potential. The common connection of R1B and R2B is connected to the inverting input of comparator 82 and defines the reference voltage V1B. The collector of Q2B is provided as an input to yet another current mirror comprising Q3B and Q4B, wherein an output of this current mirror; i.e., the collector of Q4B, is coupled through a diode D2 to the non-inverting inputs of comparators 62, 82 and 84 as well as to one end of the capacitor C1.

The output of the first comparator 62 defines is connected to a "set" input of a latch circuit L2 having a "Q" output connected to the base of a transistor Q10 having a collector and emitter each connected to opposite terminals of capacitor C1. A "reset" input of L2 is connected to an output of a NOR gate 66 having one input connected to a "Q" output of another latch circuit L1 and a second input connected to a "reset" input of latch circuit L1 and receiving an inverted EST signal ESTB. The outputs of comparators 82 and 84 are connected to separate inputs of a two-input OR gate 86, wherein an output of OR gate 86 defines an output of circuit 80 carrying the inhibit signal INH and is also connected to the "set" input of latch circuit L1.

A first mode input M1 is connected to the base of a transistor Q5A and to the base of another transistor Q11A. The collector of Q5A is connected to the collector of Q4A and the collector of Q11A is connected to the output of comparator 84. The emitters of Q5A and Q11A are connected to ground potential. A second mode input M2 is connected to the base of a transistor Q5B and to the base of another transistor Q11B. The collector of Q5B is connected to the collector of Q4B and the collector of Q11B is connected to the output of comparator 82. The emitters of Q5B and Q11B are connected to ground potential.

The section of circuit 80 that sets up the charging current for C1 and the lower reference voltage for the start of the "off" period of INH are identical to that illustrated and described with respect to FIG. 5. There is only one occurrence of the primary voltage reference VREF, Q1 and the current source that biases Q1. The repeated section includes transistors Q2x–Q5x, D1x and R1x–R4x. As described hereinabove with respect to FIG. 5, it is this set of components that establishes the charging current for C1 and the lower reference voltage. Two (or more) additional inputs Mx are provided to control which configuration setup controls the timing circuitry. When a given Mx signal is low, the associated Q5x is turned off, allowing the output current from the Q4x to pass through D1x to C1. The outputs of Q4y in the remaining repeated sections are diverted to ground through their associated Q5y. Diode D1x is present in each section to allow the charging current from a given section to be shunted to ground without disturbing the charging current for C1 from the section in control.

The lower threshold reference voltages as established at the intermediate nodes of the R1x–R2x pairs are passed to a corresponding set of comparators. The Mx signals also control whether or not the outputs from these comparators are allowed to pass high level signals to OR gate 86. When a given Mx input is low, the associated transistor Q11x is turned off, allowing the associated comparator (e.g., 82 or 84) to drive a high level signal onto the OR gate 86. The output of the OR gate 86 supplies the inhibit signal INH and the "set" input of latch circuit L1 as described hereinabove with respect to FIG. 5.

To add additional mode channels to the implementation illustrated in FIG. 7, those devices with an "xxB" designation would be duplicated and connected in parallel with the "xxA" devices as shown in FIG. 7.

Referring to FIGS. 8A–8C, example waveforms of the gate drive (GD) 90, primary coil current ($I_C$) 92 and secondary coil voltage $V_{SC}$ 94 are shown illustrating the response of the ignition coil control system 50 when the circuit 80 of FIG. 7 is used as the ring damping circuit 58 of FIG. 4 in a dual pulse system. The phased turn-on is implemented both at the beginning of the dwell cycle and at the beginning of each recharge cycle, wherein the overshoot due to ringing is substantially reduced in all pulses.

Figure 9:
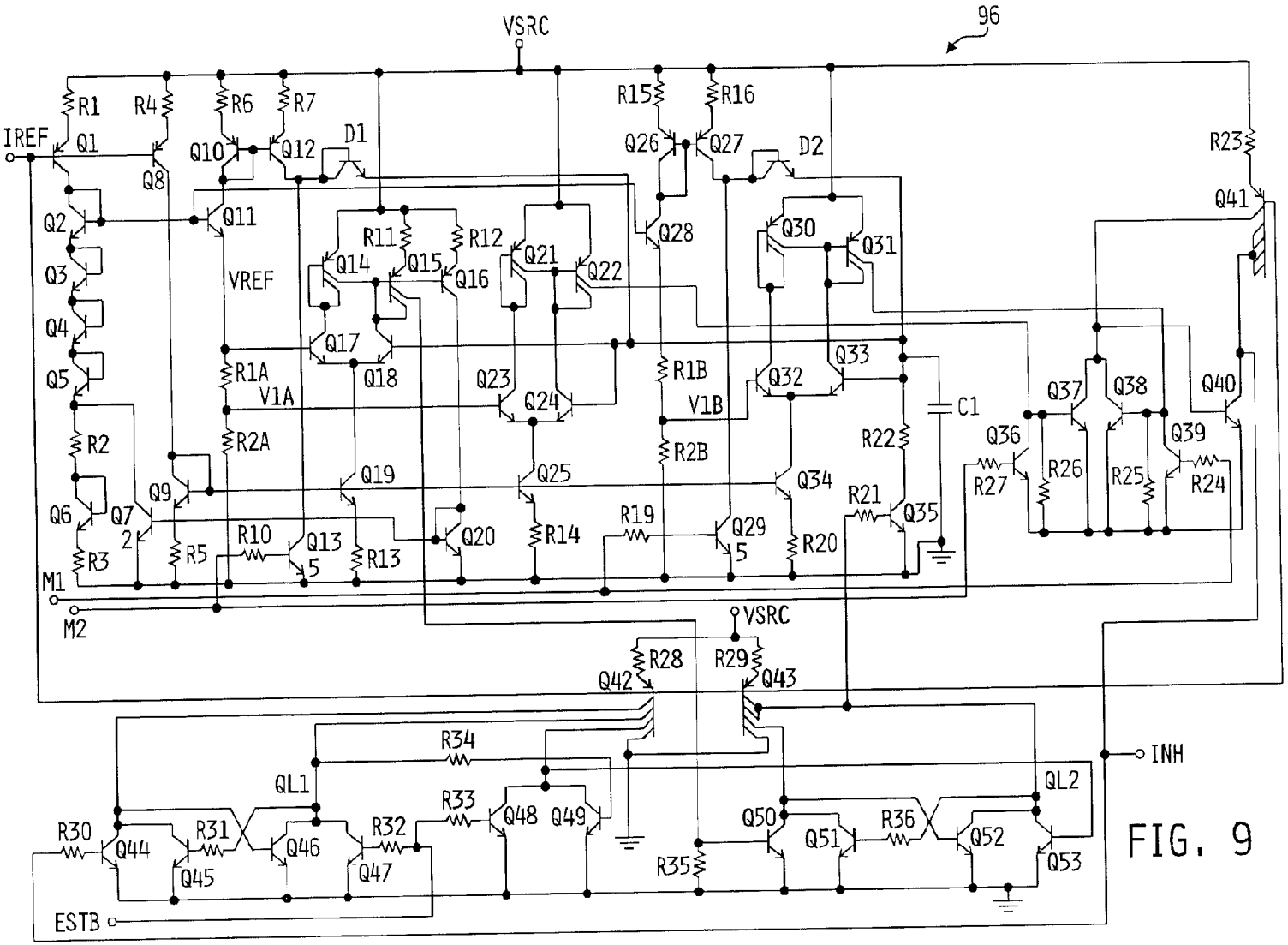
FIG. 9 is a device-level schematic illustrating one preferred embodiment of the ring damping circuit of FIGS. 4 and 7 configured for a multiple pulse ignition system in accordance with the present invention.

Referring now to FIGS. 9 and 10, one preferred embodiment of a device-level schematic 96 of the two-pulse ring damping circuit of FIG. 7, in accordance with the present invention, is shown. In the illustration of the circuitry of FIGS. 9 and 10, any transistor shown having an integer associated with it emitter is to be understood to define an emitter area that is larger than a "standard" emitter area by the indicated integer number. Similarly, any transistor shown not having an integer associated with its emitter is to be understood to define a "standard" emitter area. The circuits 96 and 98 of FIGS. 9 and 10 are preferably combined to form an integrated circuit, preferably formed in accordance with a known silicon fabrication process, although the present invention contemplates forming these circuits 96 and 98 as one or more sub-circuits from discrete components, silicon integrated circuits and/or integrated circuits formed of other known semiconductor materials.

Devices Q1–Q7 and R1–R4 form the reference voltage VREF. The circuit node IREF receives a reference voltage from a reference current generating circuit 98 illustrated in FIG. 10, wherein transistor Q1 is responsive to this reference voltage to establish a current I1 therethrough. This reference current I1 is a so-called "delta Vbe" current defined by the relationship I1=(Vt*ln(N))/RDVBE, wherein Vt is a thermal voltage, N is a ratio of emitter areas of NPN transistors used to develop the delta-Vbe current and RDVBE is a resistor sized to establish the magnitude of the current IREF. The thermal voltage Vt is given by the well-known equation (k*T)/q, wherein "k" is Boltzman's constant, "T" is temperature in degrees Kelvin and "q" is the electronic charge. The current I1 thus has a positive temperature coefficient (T.C).

The delta-Vbe current IREF is supplied to diode-tied transistors Q2–Q6 and series connected resistors R2 and R3. In one embodiment, the resulting voltage at the emitter of Q2 is four times the silicon bandgap voltage (approximately 1.25 volts), or approximately 5 volts. This voltage is relatively temperature insensitive since the negative temperature coefficient of the base-emitter voltages is offset by the positive temperature coefficient of the diffused base resistors R2 and R3. Careful selection of the total value of R2+R3 is required for this temperature balance, although the necessary calculations for setting up this balance can easily be made by one skilled in the art.

The reference voltage VREF is transferred to resistor divider strings R1A–R2A and R1B–R2B via transistors Q2, Q11 and Q28 as described hereinabove with respect to FIG. 7. The VREF voltage impressed across each of these divider strings establishes the current through them, and therefore the current ultimately sourced onto C1 by the active channel, via either the Q11–Q12 current mirror or the Q26–Q27 current mirror. Diode tied transistors D1 and D2 correspond to like numbered diodes illustrated in FIG. 7. Transistors Q13 and Q29 switch the outputs of these current mirror to ground when the corresponding mode channel is active.

Comparator 62 of FIG. 7 is composed of transistors Q14–Q19, with one of the half collectors of Q15 being the output signal. Q16 also provides an output from this comparator that is used to reduce the level of VREF, thereby providing hysteresis in the comparator circuit. The reduction in VREF is preferably accomplished by mirroring two times the Q16 collector current at the collector of Q7. This current drive effectively saturates Q7, thereby removing the voltage drop across R2, R3 and Q6 from the voltage generated at the emitter of Q2.

Comparators 82 and 84 are composed of transistor groups Q30–Q34 and Q21–Q25 respectively. The outputs of these comparators, the current sourced by Q31 and Q22, drive the NOR gate composed of transistors Q23, Q37 and Q38. The output of this gate is inverted by transistor Q40. This inverted NOR gate is represented by OR gate 86 in FIG. 7. The comparators are all biased by the multiple output current mirror composed of transistors Q9, Q19, Q25 and Q34. This mirror is driven by the current IREF produced by the delta-Vbe current generator circuit 98.

Transistors Q36 and Q39 correspond to transistors Q11A and Q11B in FIG. 7. These devices inhibit the outputs from the two matched comparators from driving the inputs of the OR gate 86 defined by transistors Q37 and Q38 when the corresponding mode channel is deactivated. Latch circuit L1 of FIG. 1 is composed of transistors Q44–Q47, and transistors Q48 and Q49 make up NOR gate 66. The output of NOR gate 66 feeds the reset input of latch circuit L2 composed of transistors Q50–Q53. The "Q" output of latch circuit L2, at the collectors of Q50 and Q53, drives the transistor Q35 to discharge capacitor C1.

While the invention has been illustrated and described in detail in the foregoing drawings and description, the same is to be considered as illustrative and not restrictive in character, it being understood that only the preferred embodiments have been shown and described and that all changes and modifications that come within the spirit of the invention are desired to be protected.

What is claimed is:

1. An ignition control circuit, comprising:

a first circuit producing first, second and third reference voltages;

a capacitor;

a second circuit responsive to a spark control signal to begin charging said capacitor;

a third circuit responsive to a first mode control signal to enable an inhibit signal when a charge on said capacitor reaches said first reference voltage and to disable said inhibit signal when said charge on said capacitor reaches said second reference voltage;

a fourth circuit responsive to a second mode control signal to enable said inhibit signal when said charge on said capacitor reaches said third reference voltage and to disable said inhibit signal when said charge on said capacitor reaches said second reference voltage; and a fifth circuit responsive to said inhibit signal to disable current flow through an ignition coil when said inhibit signal is enabled and to enable current flow through said ignition coil when said inhibit signal is disabled.

2. The ignition control circuit of claim 1 wherein said first circuit includes first and second resistors connected in series, said first reference voltage corresponding to a voltage across one of said first and second resistors and said second reference voltage corresponding to a voltage across both of said first and second resistors.

3. The ignition control circuit of claim 2 further including a first current mirror circuit having an output connected to said capacitor;

wherein one of said first and second resistors is connected to an input of said first current mirror circuit, said first and second resistors defining a first current therethrough and supplying said first current to said input of said first current mirror circuit;

and wherein said second circuit is responsive to said spark control signal and said first mode control signal to begin charging said capacitor with said first current.

4. The ignition control circuit of claim 3 wherein said first circuit includes third and fourth resistors connected in series, said third reference voltage corresponding to a voltage across one of said third and fourth resistors.

5. The ignition control circuit of claim 4 further including a second current mirror circuit having an output connected to said capacitor;

wherein one of said third and fourth resistors is connected to an input of said second current mirror circuit, said third and fourth resistors defining a second current therethrough and supplying said second current to said input of said second current mirror circuit;

and wherein said second circuit is responsive to said spark control signal and to said second mode signal to begin charging said capacitor with said second current.

6. The ignition control circuit of claim 5 wherein said third circuit includes an output defining said inhibit signal and a first comparator circuit having a non-inverting input connected to said capacitor, an inverting input receiving said first reference voltage and an output coupled to said output of said third circuit, said first comparator circuit enabling said inhibit signal when said charge on said capacitor reaches said first reference voltage.

7. The ignition control circuit of claim 6 wherein said third circuit includes a second comparator circuit having a non-inverting input connected to said capacitor, an inverting input receiving said third reference voltage and an output coupled to said output of said third circuit, said second comparator circuit enabling said inhibit signal when said charge on said capacitor reaches said third reference voltage.

8. The ignition control circuit of claim 7 further including an OR gate having first and second inputs each connected to separate ones of said outputs of said first and second comparator circuits respectively and an output defining said output of said third circuit, said OR gate responsive to said first mode signal to pass said output of said first comparator circuit to said output thereof while inhibiting said output of said second comparator circuit from said output thereof, said OR gate responsive to said second mode signal to pass said output of said second comparator circuit to said output thereof while inhibiting said output of said first comparator circuit from said output thereof.

9. The ignition control circuit of claim 8 wherein said second circuit includes:

a switching device connected across said capacitor; and a third comparator circuit having a non-inverting input connected to said capacitor, an inverting input receiving said second reference voltage, and an output coupled to said switching device;

wherein said third comparator circuit is operable to activate said switching device to thereby discharge said capacitor when said charge on said capacitor reaches said second reference voltage and to otherwise deactivate said switching device to thereby allow charging of said capacitor.

10. The ignition control circuit of claim 1 further including a current source supplying a current;

and wherein said second circuit is responsive to said spark control signal to begin charging said capacitor with said current.

11. The ignition control circuit of claim 10 wherein said second circuit includes a switching device connected across said capacitor;

and wherein said second circuit is operable to deactivate said switching device to thereby allow charging of said capacitor with said current, and to activate said switching device to discharge said capacitor.

12. The ignition control circuit of claim 11 wherein said second circuit includes a first latch circuit having a reset input and an output connected to said switching device, said first latch circuit responsive to said spark control signal at said reset input to reset said first latch circuit and produce a logic low signal at said output, said logic low level output signal of said first latch circuit deactivating said switching device.

13. The ignition control circuit of claim 12 wherein said second circuit includes a second latch circuit having a reset input receiving said spark control signal and an output connected to a first input of a NOR gate, said NOR gate having a second input receiving said spark control signal and an output connected to said reset input of said first latch circuit, said second latch circuit responsive to a logic low level signal of said spark control signal to produce a logic low level signal at said output thereof, said NOR gate responsive to said logic low level output signal at said output of said second latch circuit and said logic low level of said spark control signal to provide a logic low level input signal to said reset input of said first latch circuit.

14. The ignition control circuit of claim 13 wherein said second latch circuit includes a set input responsive to said enabled state of said inhibit signal to produce a logic high level at said output thereof, said NOR gate responsive to said logic high level at said output of said second latch circuit to supply a logic low level signal to said reset input of said first latch circuit.

15. A method of controlling an ignition system, comprising the steps of:

charging a capacitor in response to a spark control signal;

comparing a charge on said capacitor with a first reference voltage in response to a first mode signal;

comparing said charge on said capacitor with a second reference voltage in response to a second mode signal;

comparing said charge on said capacitor with a third reference voltage, said third reference voltage greater than said first and second reference voltages;

disabling current flow through an ignition coil when said charge on said capacitor reaches either of said first and second reference voltages; and enabling current flow through said ignition coil when said charge on said capacitor reaches said third reference voltage.

16. The method of claim 15 wherein said disabling step includes:

enabling an inhibit signal when said charge on said capacitor reaches either of said first and second reference voltages;

disabling current flow through said ignition coil when said inhibit signal is enabled.

17. The method of claim 16 wherein said enabling step includes:

disabling said inhibit signal when said charge on said capacitor reaches said third reference voltage; and enabling current flow through said ignition coil when said inhibit signal is disabled.

18. The method of claim 17 further including the step of discharging said capacitor when said charge on said capacitor reaches said third reference voltage.

* * * * *